United States Patent [19]

Monk

[11] Patent Number: 4,543,671

[45] Date of Patent: Oct. 1, 1985

[54] HEATED MITTEN

[76] Inventor: Peter H. Monk, 1290 Kenilworth, Town of Mount-Royal, Quebec, Canada, H3R 2R7

[21] Appl. No.: 615,571

[22] Filed: May 31, 1984

[30] Foreign Application Priority Data

Jul. 6, 1983 [CA] Canada ..... 431887

[51] Int. Cl.[4] ..... A41D 00/00

[52] U.S. Cl. ..... 2/158; 2/160

[58] Field of Search ..... 2/158, 159, 160, 161 A, 2/16, 20

[56] References Cited

U.S. PATENT DOCUMENTS 1,970,081 8/1934 Eisendrath ..... 2/158 X
2,103,594 12/1937 Murray ..... 2/160
3,569,666 3/1971 Murphy ..... 2/159 X
3,623,966 12/1972 Arron ..... 2/158 X
4,040,126 8/1977 Cecil ..... 2/161 A

FOREIGN PATENT DOCUMENTS 2118023 10/1983 United Kingdom ..... 2/158

*Primary Examiner*—Louis K. Rimrodt
*Assistant Examiner*—Joseph S. Machuga
*Attorney, Agent, or Firm*—Cushman, Darby & Cushman

[57] ABSTRACT

A mitten having a pouch disposed in its interior which is supported by the mitten so as to be moveable relative to the hand of a user. The mitten is provided with an opening in its exterior which communicates with the interior of the pouch whereby a heating element may be placed in the pouch.

A closure flap is provided to seal the opening.

4 Claims, 4 Drawing Figures

HEATED MITTEN

This invention relates to mittens, that is hand coverings which are constructed so as to totally enclose all the fingers of a user in a common compartment.

Mittens are used by sportsmen, workers and others who are exposed to low temperature weather conditions, and it is sometimes desirable or necessary to include heating means in the mitten.

BACKGROUND ART

Mittens have been proposed in the past which include a compartment for a heating element, but such compartments are positioned so as to heat only a predetermined portion of the mitten.

For example, in U.S. Pat. Specification No. 1,970,081, there is disclosed a mitten provided with a compartment for a heating element, which compartment is disposed in that portion of the mitten which covers the back of the hand of a user and is fixed relative thereto.

DISCLOSURE OF INVENTION

It is an object of the present invention to provide a mitten having a compartment or pouch for a heating element which is adjustable or moveable whereby it can be positioned relative to different parts of the hand of a user.

BRIEF DESCRIPTION OF DRAWINGS

In order that the invention can be understood and carried into effect and so that the above object will become apparent, a mitten in accordance with the invention will now be described, by way of example only, with reference to the accompanying drawings in which.

Figure 2:
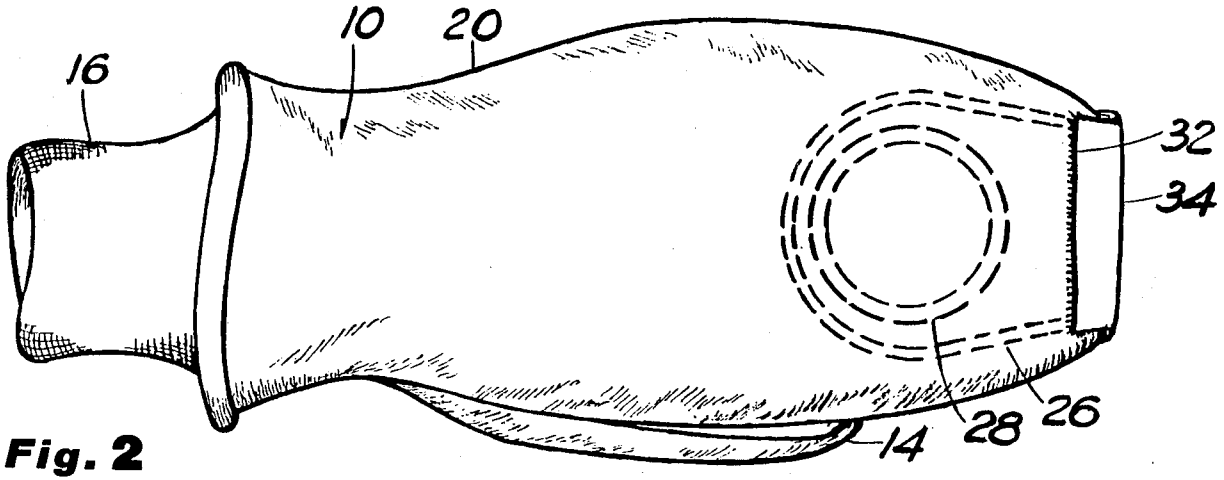
FIG. 2 is a plan view of the mitten shown in FIG. 1.
Figure 1:
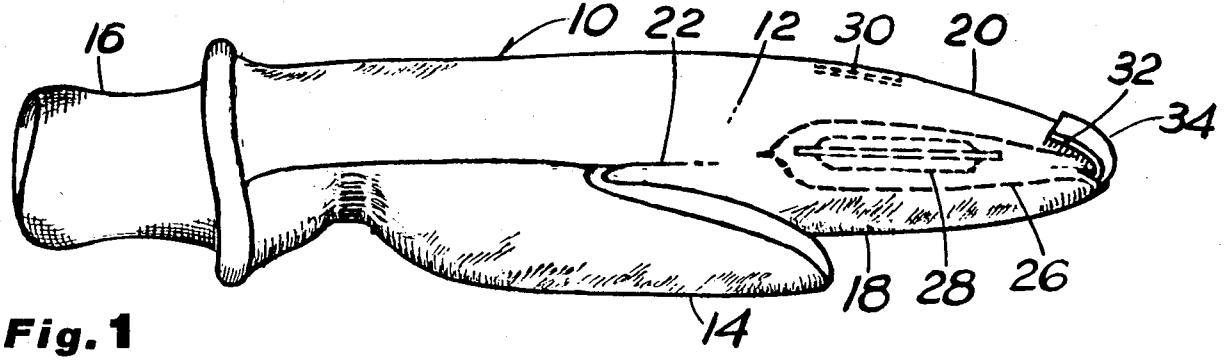
FIG. 1 is a side view of a mitten in accordance with the present invention.

Referring to the drawings 10 indicates a mitten having a main body 12 for covering the hand and fingers of a person, and a thumb sheath 14 together with an elasticated wrist band 16. The main body comprises a palm or front portion 18 and a back or rear portion 20, joined together by stitching as indicated at 22, or by any other means known to those skilled in the art.

Figure 3:
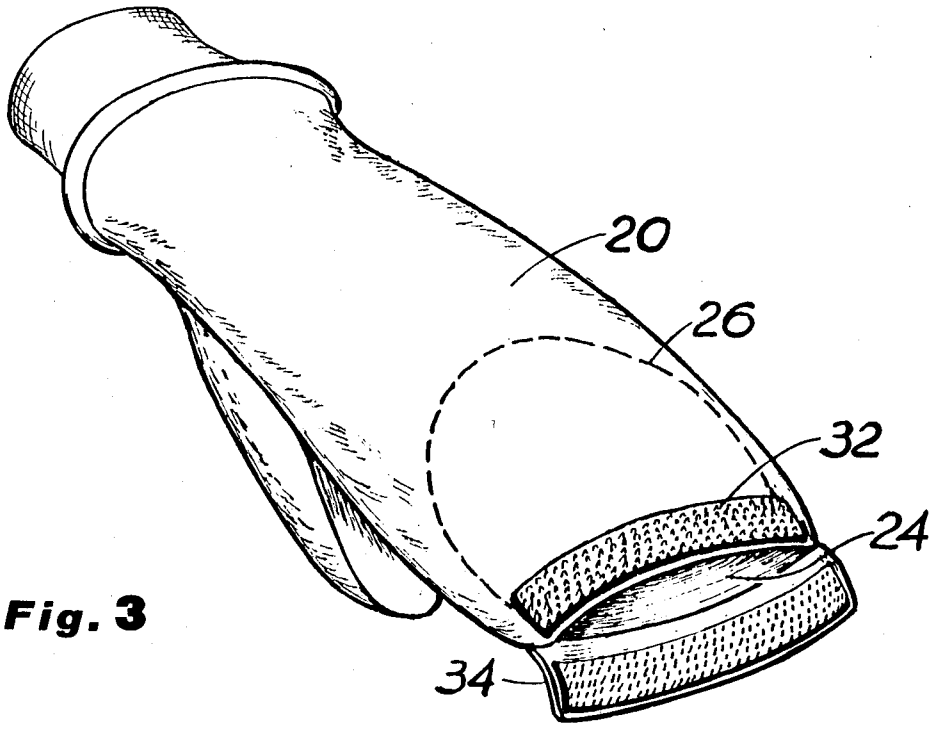
FIG. 3 is an enlarged fragmentary view showing the inlet to the heating element compartment with the closure flap positioned to permit access to the compartment.
Figure 4:
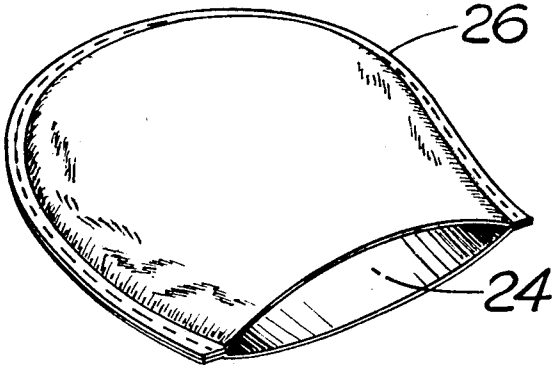
FIG. 4 is a perspective view of the pouch of the mitten shown as a separate member.

However, it will be seen that the portions 18 and 20 are not joined together all the way along their co-terminous edges, as shown particularly in FIG. 3 of the drawings.

An opening 24 is left between the portions 18 and 20 at the tip of the mitten to permit access to be gained to a compartment or pouch 26 within the mitten which is provided to receive a heating element 28.

The compartment or pouch 26 is formed in the material 30 lining the mitten and is so formed that access to the compartment or pouch cannot be gained from inside the mitten. Means are provided for sealing the compartment 26, the said means comprising a strip 32 of fibrous or felt like material secured to the back portion 20 of the mitten along the length of the opening 24, and a closure member 34 secured to the front member 18 of the mitten 10. The closure member 34 has hook like members provided thereon which engage with the fibrous or felt like material on the strip 32 to retain the closure member over the opening 24, and retain the heating element 28 in the compartment 26.

Materials incorporating the fibrous or felt like material and the hook like members are sold under the trade mark "VELCRO".

However, it will be appreciated that other means may be provided for securing the closure member 34 in a position to close the compartment 26. For example, press-studs may be used. Alternatively, the compartment may be closed by a slide fastener.

The palm or front and back or rear portions of the mitten may be made from a laminated material of which the inner layer forms the lining of the mitten. When such a laminated material is employed, the compartment or pouch is formed separately and then attached to the inner layer of the laminate material in a position which will permit access to its interior via the opening 24.

Whilst in the above described mitten 10, the opening 24 is situated at the tip thereof it may be located in any other convenient position. It will also be appreciated that whilst the heating element compartment or pouch is formed integrally with the material forming the lining of the mitten, it can be formed separately and then attached to the mitten in a position which will permit access to its interior via the opening 24.

When the above described mitten is in use, and the surrounding temperatures are such that it becomes necessary to insert a heating element in the compartment 26, the compartment can be manoeuvered to a position whereby the heating element can be placed adjacent the front or back of the hand of a user as desired.

For example, a skier would find it convenient to place the compartment adjacent the back of his hand.

The embodiments of the invention in which an exclusive property or privilege is claimed are defined as follows:

1. A mitten comprising:

a body portion having an opening at its end proximate the location of the fingers of a hand to be inserted therein;

a pouch disposed within said opening in the interior of said body portion of said mitten, said pouch being supported by said mitten so as to be movable relative to the hand of a user such that said mitten does not interfere with an object being gripped by said user, and means for sealing said pouch with a snap or sliding action.

2. A mitten claimed in claim 1, in which the pouch is formed integrally with a lining for the mitten.

3. A mitten as claimed in claim 1, in which the pouch comprises a separate member attached to the mitten.

4. A mitten as claimed in claim 1 or 2, in which a heating element is placed in said pouch.

* * * * *